US006240260B1

(12) United States Patent
Krupica et al.

(10) Patent No.: US 6,240,260 B1
(45) **Date of Patent: *May 29, 2001**

(54) METHOD AND APPARATUS FOR BUFFER TRANSFER OF MEDIA SHEETS BETWEEN COMPONENTS IN AN IMAGESETTING SYSTEM

(75) Inventors: Libor Krupica, Nashua, NH (US); Arthur R. Newton, Jr., North Reading, MA (US)

(73) Assignee: Agfa Corporation, Wilminton, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/240,985

(22) Filed: Jan. 29, 1999

(51) Int. Cl.[7] ..... B41J 17/02

(52) U.S. Cl. ..... 396/612; 347/262; 347/264; 271/304; 355/27; 355/28; 242/533.5

(58) Field of Search ..... 396/570, 612, 396/613, 622, 624; 355/27, 28, 47; 347/262, 264, 215; 271/303, 304, 186; 242/533.2, 533.4, 533.5, 533.6

(56) References Cited

U.S. PATENT DOCUMENTS

| | | | | |
|---|---|---|---|---|
| 4,511,098 | | 4/1985 | Konaya . | |
| 4,593,867 | | 6/1986 | Yamasaki . | |
| 5,465,955 | * | 11/1995 | Krupica et al. | 271/265.02 |
| 5,585,904 | | 12/1996 | Yamamoto et al. | 355/271 |
| 5,667,164 | | 9/1997 | Yamamoto et al. | 242/564.4 |
| 5,769,301 | | 6/1998 | Hebert et al. | 226/108 |
| 5,771,057 | * | 6/1998 | Rombult et al. | 347/215 |
| 5,815,243 | * | 9/1998 | Bailey et al. | 355/27 |
| 5,868,387 | * | 2/1999 | Kida et al. | 271/304 |
| 5,949,466 | * | 9/1999 | Kerr et al. | 347/262 |

FOREIGN PATENT DOCUMENTS 2128593 5/1984 (GB) .

* cited by examiner

*Primary Examiner*—Alan A. Matthews
(74) *Attorney, Agent, or Firm*—Robert A. Sabourin

(57) ABSTRACT

A system and method for transferring and buffering sheets of media between first and second components of an imagesetting system operates by: rotating a transfer buffer having at least two storage devices, to align a first storage device with the first component while concurrently aligning a second storage device with the second component; transferring a first sheet of said media from the first component to the first storage device; rotating the transfer buffer to align the first storage device with the second component while concurrently aligning the second storage device with the first component; and transferring the first sheet of said media from the first storage device to the second component while simultaneously transferring a second sheet of said media from the first component to the second storage device. The transfer system includes: a transfer buffer; at least two storage devices mounted onto the transfer buffer, each storage device moveable within the transfer buffer and capable of storing one sheet of imaged media; and a controller for automatically controlling operation of the transfer system.

11 Claims, 9 Drawing Sheets

METHOD AND APPARATUS FOR BUFFER TRANSFER OF MEDIA SHEETS BETWEEN COMPONENTS IN AN IMAGESETTING SYSTEM

FIELD OF THE INVENTION

The invention relates generally to buffering and transferring sheets of cut media between functional components having different processing speeds within an imagesetting system, and more specifically to a method and system for compensating for a speed differential between an imagesetter and an on-line development/finishing processor in an electronic pre-press system.

BACKGROUND OF THE INVENTION

In existing electronic pre-press systems, images to be printed by offset printing are scanned from photographic sources and digitized. The digitized images are then transmitted to a raster image processor (RIP) for half-tone screening and image rasterization. The rasterized image is then transmitted to an imagesetter for recording of the image onto a medium. Such recording is referred to as imaging or imagesetting, and may for example be performed by photographic recording of an image onto a photosensitive medium such as paper, film, or printing plates. A medium which has had an image recorded onto it by an imagesetter is referred to as imaged medium.

Existing pre-press systems typically include independent functional units for recording images and for subsequent processing. A typical photographic imagesetter operates to record a predefined image onto a medium, for example by first mounting the medium onto the internal surface of a drum (i.e. in an internal drum imagesetter), then exposing the medium with a laser beam via a rotatable, optically reflective element mounted on the interior of the drum. The medium typically may be supplied as a web or as a cut sheet.

Subsequent to imaging, the imaged medium is passed to a development/finishing processor, where the medium will undergo chemical processing for photographically developing, fixing and washing. Alternatively, if the image was burned into the media by a laser, then mechanical finishing would occur in the processor. If the media was supplied by a continuous web, each sheet of exposed media is cut prior to entry into the processor.

Early pre-press systems used off-line development processors. In such early systems, imaged media was collected onto a take up cassette connected to an output of the imagesetter, and then manually transported to the off-line processor. More recent systems have coupled the imagesetter to an on-line processor, which inputs the imaged media directly, automatically from the imagesetter.

A significant drawback of existing systems using on-line processors results from the different processing speeds of the imagesetter and the processor. This and other problems were addressed in U.S. Pat. No. 5,769,301 issued Jun. 23, 1998 to Hebert et al. herein incorporated by reference in its entirety for supplemental background information which is not essential but is helpful in appreciating the applications of the present invention. Hebert et al. discloses a media transport bridge for use in transporting and buffering imaged media between an imagesetter and a processor. When a medium is output from the imagesetter, it is transferred to a bridge mechanism between the imagesetter and the processor. The bridge mechanism holds the medium for a predetermined period of time while waiting for the processor to become available. When the processor's availability is detected, the medium is transferred from the bridge to the processor, and the bridge thereafter becomes available to store a second sheet of media from the imagesetter. However, during the time while the bridge is waiting for the processor to accept the second sheet of media, the imagesetter may have to be stalled, waiting for the bridge to become available. Such stalling of the imagesetter potentially causes an unacceptable reduction in overall media throughput. Moreover, existing bridge mechanisms often have high profiles, resulting in undesirably large form factors for products in which they are included.

SUMMARY

It is an object of the present invention to provide in an imagesetting system an apparatus and method for transferring and buffering imaged media sheets between two components so as to compensate for any transfer speed differential between the components. It is another object to provide such an apparatus and method for transferring and buffering imaged media sheets between an imagesetter and an image processor in an imagesetting system, so that the apparatus is compact with a low profile which significantly decreases the overall weight and dimensions of the imagesetting system. These and other objects of the present invention will become apparent in view of the following description, drawings and claims.

A system and method for transferring and buffering sheets of media between first and second components of an imagesetting system operates by: moving a transfer buffer having at least two storage devices, to align a first storage device with the first component while concurrently aligning a second storage device with the second component; transferring a first sheet of said media from the first component to the first storage device; moving the transfer buffer to align the first storage device with the second component while concurrently aligning the second storage device with the first component; and transferring the first sheet of the media from the first storage device to the second component while simultaneously transferring a second sheet of the media from the first component to the second storage device. The transfer system includes: a transfer buffer having at least two storage devices mounted thereon, each said storage devices moveable within the transfer buffer and capable of storing one sheet of imaged media; and a controller for automatically controlling operation of the transfer system.

BRIEF DESCRIPTION OF THE DRAWINGS

The invention will be more fully understood by reference to the following detailed description of the preferred embodiments in conjunction with the drawings (not necessarily drawn to scale), where like components are labeled with the same reference numerals and where.

DETAILED DESCRIPTION OF THE PREFERRED EMBODIMENTS

Figure 1:
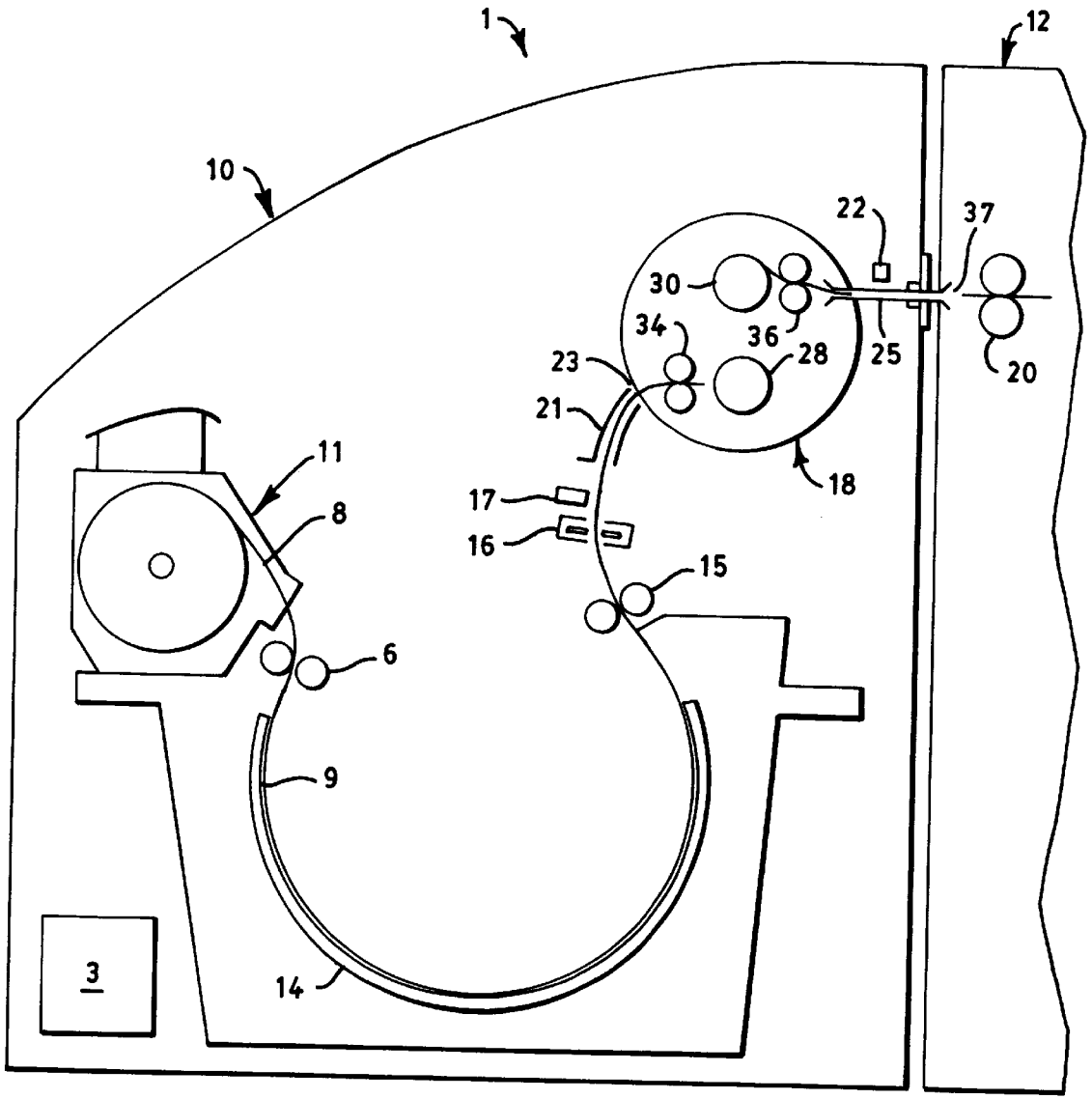
FIG. 1 is a schematic view of an imagesetting system built in accordance with the principles of the invention and including an internal drum imagesetter, a first preferred embodiment of a transfer buffer therein, and an on-line processor.

FIG. 1 is a schematic view of selected portions of an electronic pre-press system 1 including an internal drum imagesetter 10 and an on-line development/finishing processor 12. The imagesetter 10 includes: a media supply cassette 11 which supplies a photosensitive media 8 as a web; drum input rollers 6; an imaging drum 14; drum output rollers 15, web cutters 16; a first sensor 17; a transfer buffer 18; a second sensor 22; and a controller 3. The controller 3 automatically controls and runs a predetermined sequence of operations of the imagesetting system 1. The processor 12 includes a pair of input rollers 20.

During operation of the system 1 of FIG. 1, a portion of the media 8 resident in the media supply cassette 11 is drawn onto the internal drum surface 9 of the drum 14 via drive rollers 6 until the leading edge of the media 8 is detected by the sensor 17. A laser imaging system (not shown) transfers and records an image onto the media resident within the drum. The laser imaging system typically includes a laser diode located at or near the main central axis of rotation of the drum on a carriage that allows translation along the drum axis. The output beam from the laser diode is scanned by a rotating mirror across the media on surface 9 in successive circumferentially extending bands or paths referred to as scan lines. The laser diode output beam exposes specific pixel locations of the media along those scan lines to form the desired image. Because the imaged media is associated with a single color component of the image, the laser diode is turned-on or off for those pixel locations that contain that color component and depending on whether a positive or negative image is being generated.

After imaging, the media is thereafter transferred from the drum 14 to the transfer buffer 18 via drive rollers 15. The media is transferred through a media path from the drum which in this example is defined as the media path traversing from the rollers 15 to the opening 23 between the platens 21. After a predetermined length of the media 8 passes by the sensor 17, the cutters 16 cut the media. The sheet of cut, imaged media entering the transfer buffer 18 continues being drawn into the system 18 by drive rollers 34 until the trailing edge (not shown) of the sheet is in the vicinity of the opening 23. Another strip of media is drawn into the drum 14 by rollers 6 until the leading edge is again detected by the sensor 17. The operations of the imagesetting system 1 are controlled by a pre-installed software program in the controller 3. Moreover, the web supply roll 11 of FIG. 1 may be replaced by a source of precut sheets of media.

As described above, sheets of cut, imaged media are moved into the transfer buffer 18 after imaging in the drum 14. There they are stored in one of the storage devices 28 or 30, before being transferred to the processor 12. A preferred configuration for the transfer buffer 18 includes two storage devices 28 and 30, although more than two storage devices could be used if desired.

Figure 2:
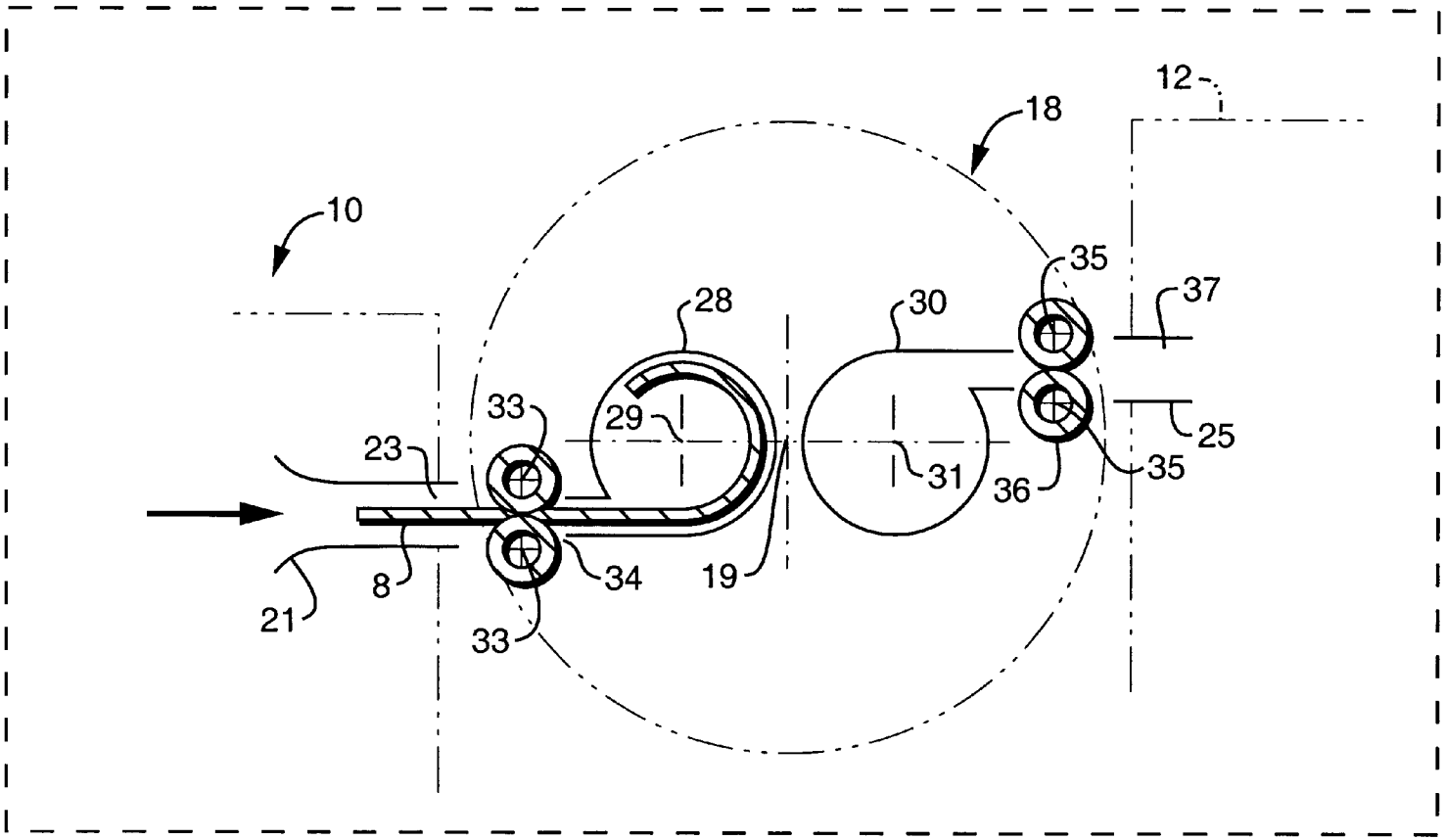
FIGS. 2, 3 and 4 are schematic views of various orientations of components of a second preferred embodiment of a transfer buffer during normal operations.

FIG. 2 is a schematic view of a second preferred embodiment of a transfer buffer 18 in a first, i.e. initial, orientation. The nip between the rollers 34 is aligned with the opening 23 of the platens 21 so that the cut, imaged media 8 will pass between the rollers 34 and enter into the first storage device 28. Similarly, the nip between the rollers 36 is concurrently aligned with the platens 25 which in turn is aligned with the opening 37 of the processor 12. In this embodiment, the first storage device 28 includes a pair of driven rollers 34 which operate to draw the media sheet 8 into the first storage device 28 until the trailing edge of the sheet is in the vicinity of the opening 23. A second storage device 30 includes the drive rollers 36. The storage devices 28 and 30 are preferably rollers which will be described in more detail hereafter. However, any kind of storage devices which can be used for storing media can be used, such as rollers, nip rollers, cassettes, containers of any shape, etc. Moreover, the storage device 28 and 30 (or the whole transfer buffer 18) could optionally be designed to be easily removable by an operator so that they could be stored for future use, or transferred to another system, if desired.

Figure 3:
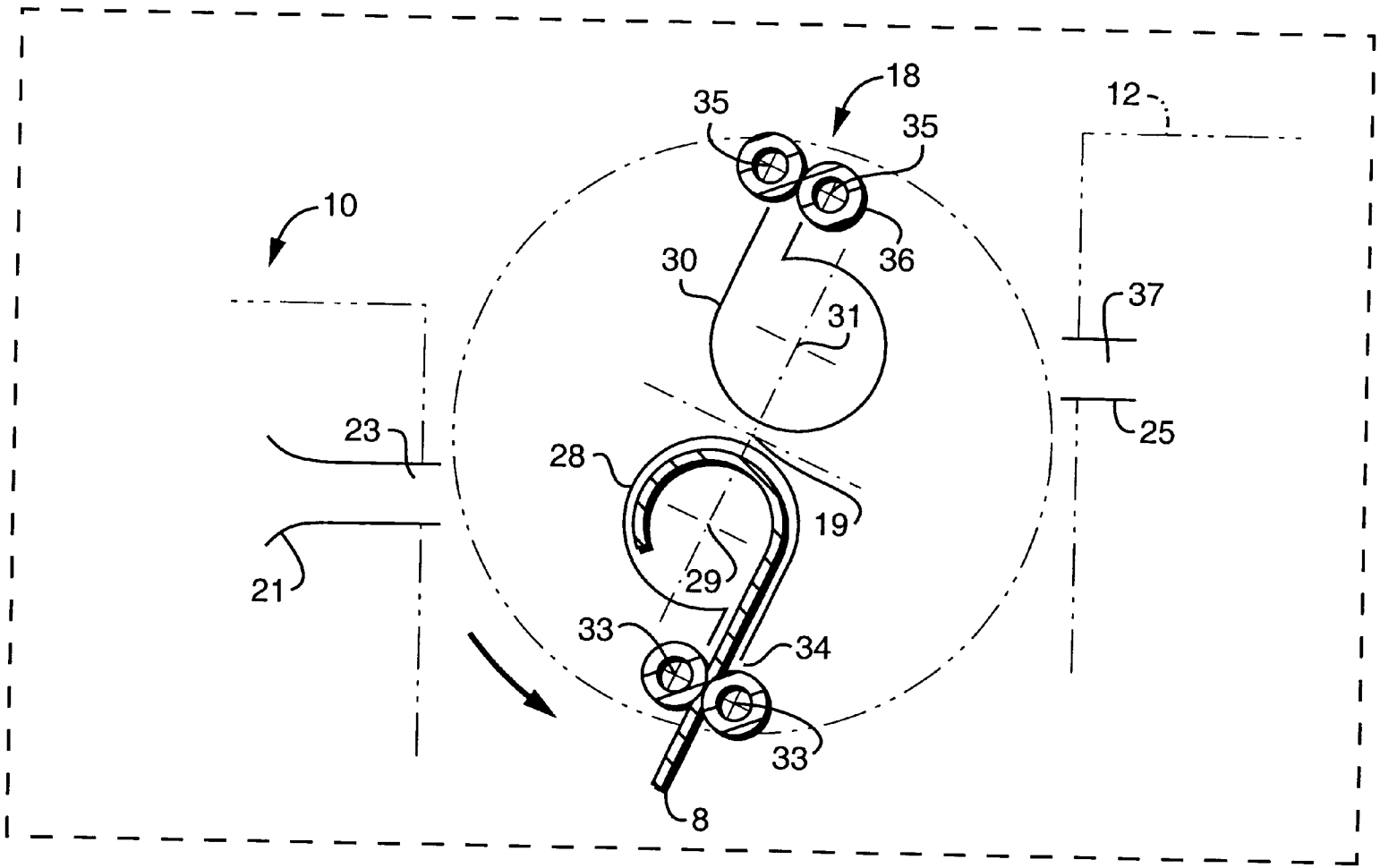
Figure 4:
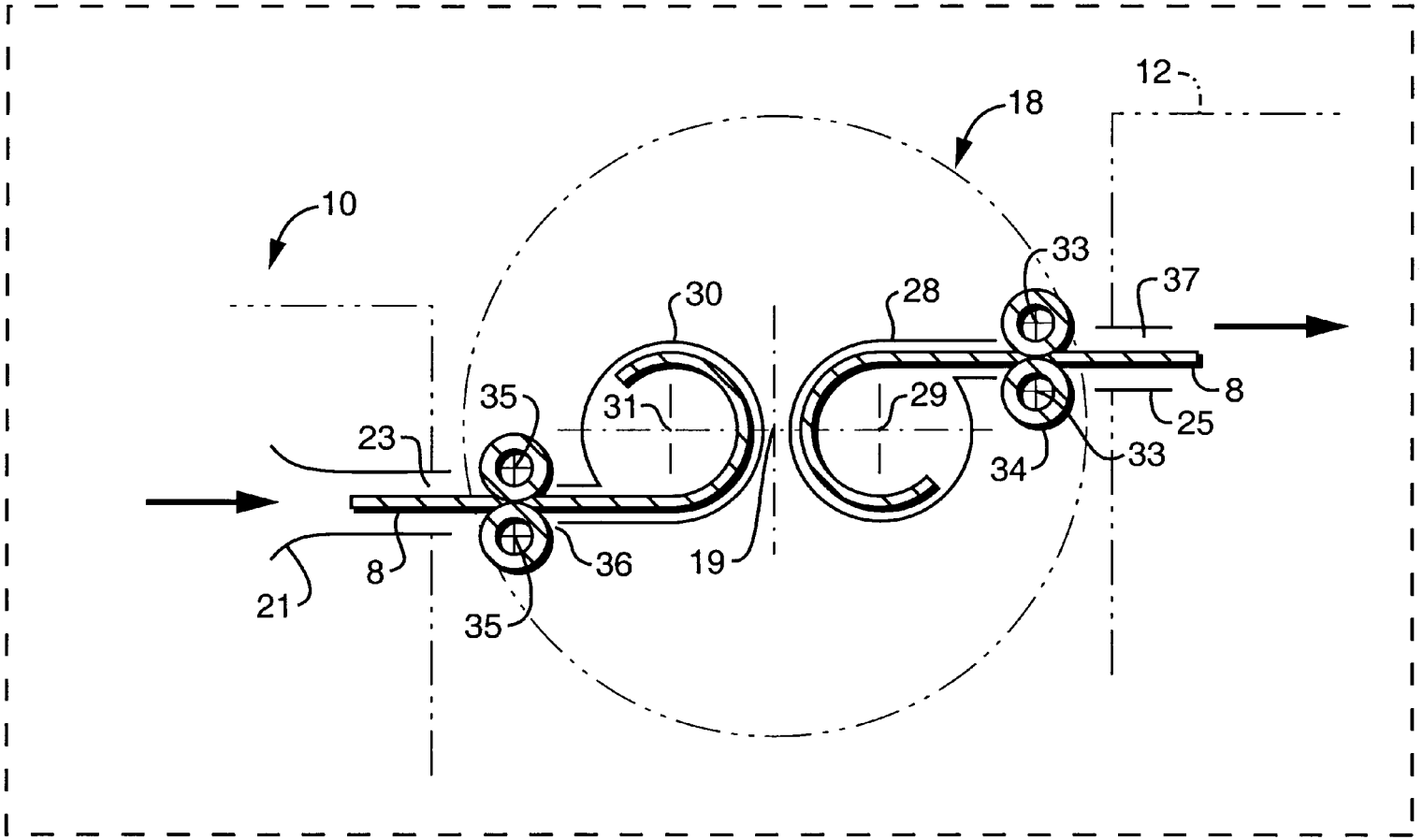

After the cut sheet of imaged media 8 is completely wound into the first storage device 28, the transfer buffer 18 is rotated about its transfer buffer axis 19 as shown in FIG. 3 to a subsequent orientation shown in FIG. 4 where the nip between the rollers 34 is aligned with the opening 37 of the processor 12 and the nip between the rollers 36 is aligned with the opening 23 of the platens 21. Note that during rotation of the storage devices 28 and 30 about their respective axes, 29 and 31, within the transfer buffer 18 a portion of the medium sheet 8 remains in contact with the drive rollers 34 so that the sheet can be subsequently easily removed from the first storage device via the drive rollers 34.

In FIG. 4, the drive rollers 34 transfer the medium sheet 8 from the first storage device 28 to the processor 12. Another sheet of imaged media 8 is simultaneously transported through the opening 23 of the platens 21, to the nip between the drive rollers 36, and into the second storage device 30 as shown. While the exemplary embodiment of FIGS. 1–4 shows a transfer buffer having two media storage devices mounted thereon, three or more media storage devices may be used if desired.

As the sheet of exposed media 8 exits the transfer buffer 18 and moves towards the processor 12, it is detected by a second sensor 22 (see FIG. 1), which operates to generate a media present signal. The media present signal may be used to initiate driving of the input rollers 20 in the processor 12.

Figure 5C:
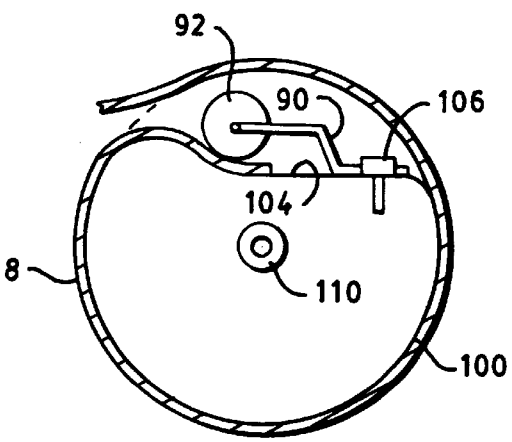
FIG. 5C is an end view of the media storage device of FIG. 5A having a medium partially wrapped thereon.
Figure 5B:
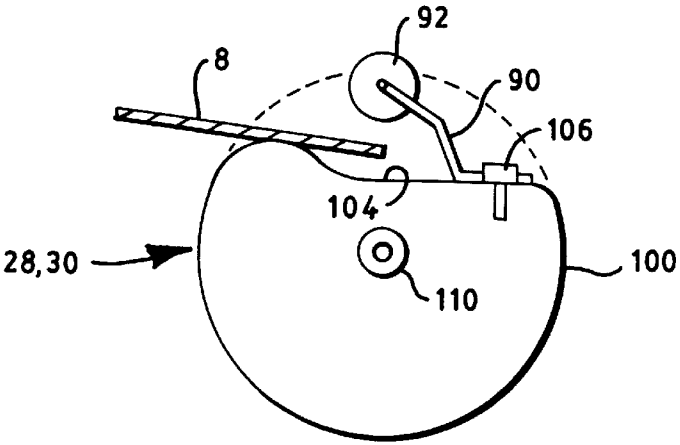
FIG. 5B is an end view of the media storage device of FIG. 5A just prior to acceptance of a medium for storage.
Figure 5A:
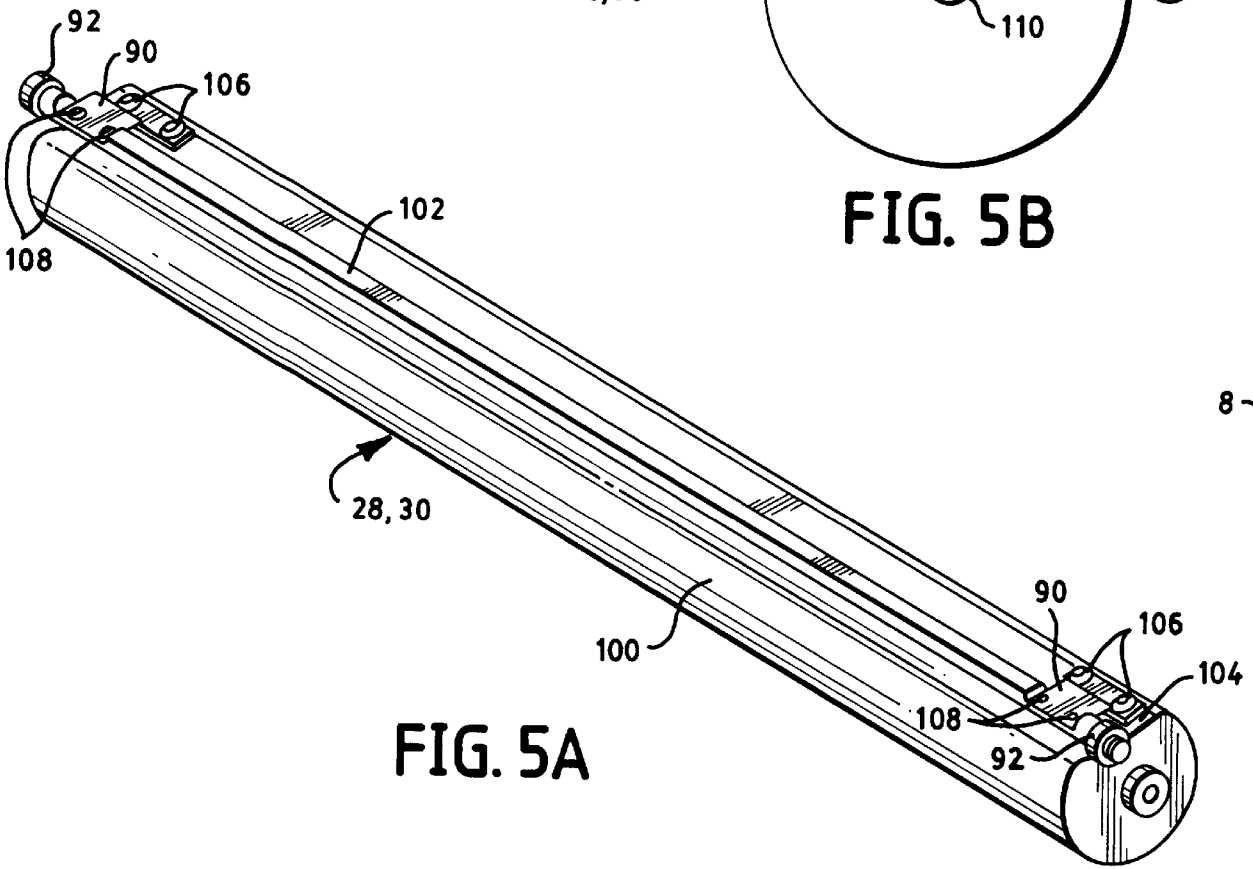
FIG. 5A is a perspective view of a media storage device used with the transfer buffer of FIG. 1.

The first preferred embodiment of the transfer buffer 18 and associated hardware is further illustrated by a rotatable transfer buffer 18 in FIGS. 5A, 5B, 5C, 6 and 7A–7D. Each storage device 28 or 30 is constructed as illustrated in FIG. 5A. They each include: a body 100 substantially shaped as a roller and having a surface 104; an axle 110 of the roller 100; two or more leaf springs 90 fastened to the surface 104 via fasteners 106; a retaining rod 102 fastened to the leaf springs 90 via fasteners 108; and wheel bearings 92 at either end of the rod 102. The bearings 92 and axles 110 each extend beyond the end surfaces 114 of the rollers 100.

Figure 7A:
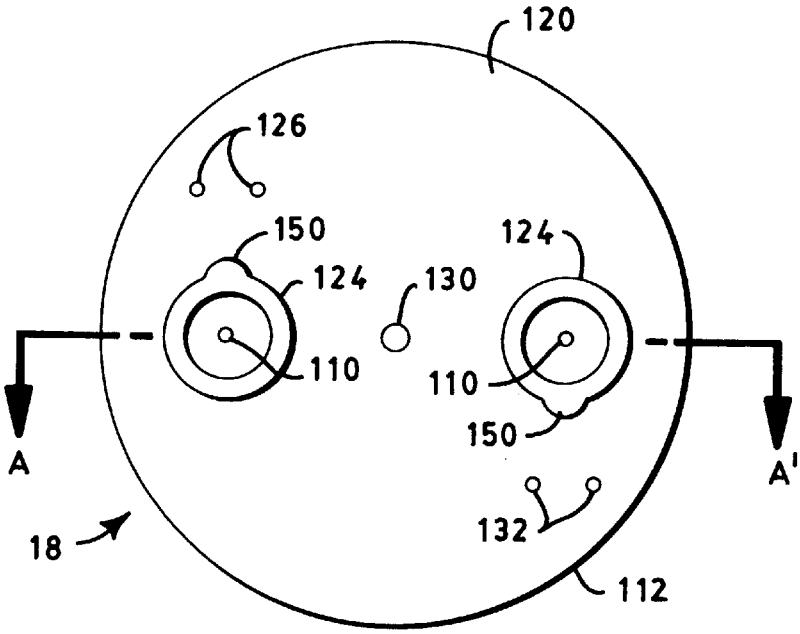
FIG. 7A illustrates an inside surface of an end plate of the transfer buffer of FIG. 1.
Figure 7C:
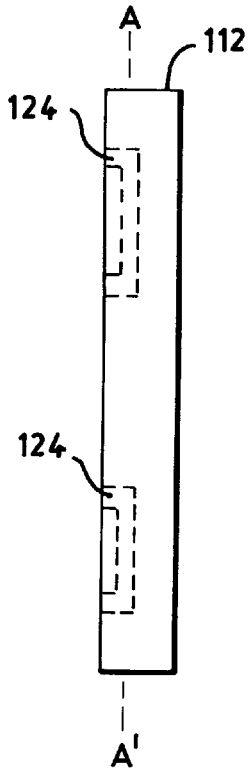
FIG. 7C is a cross-sectional view along line A–A' of the end plate of FIG. 7A.
Figure 7B:
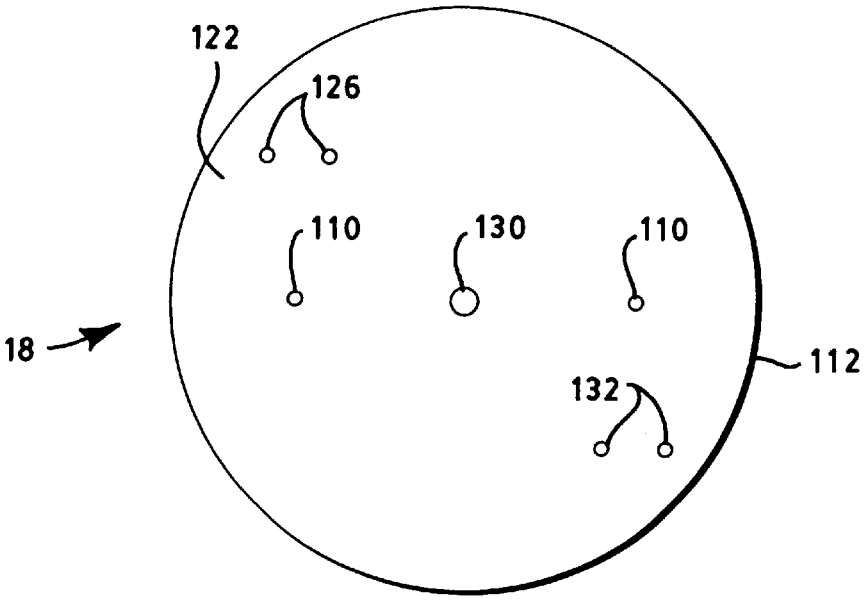
FIG. 7B illustrates an outside surface of an end plate of the transfer buffer of FIG. 1.
Figure 7D:
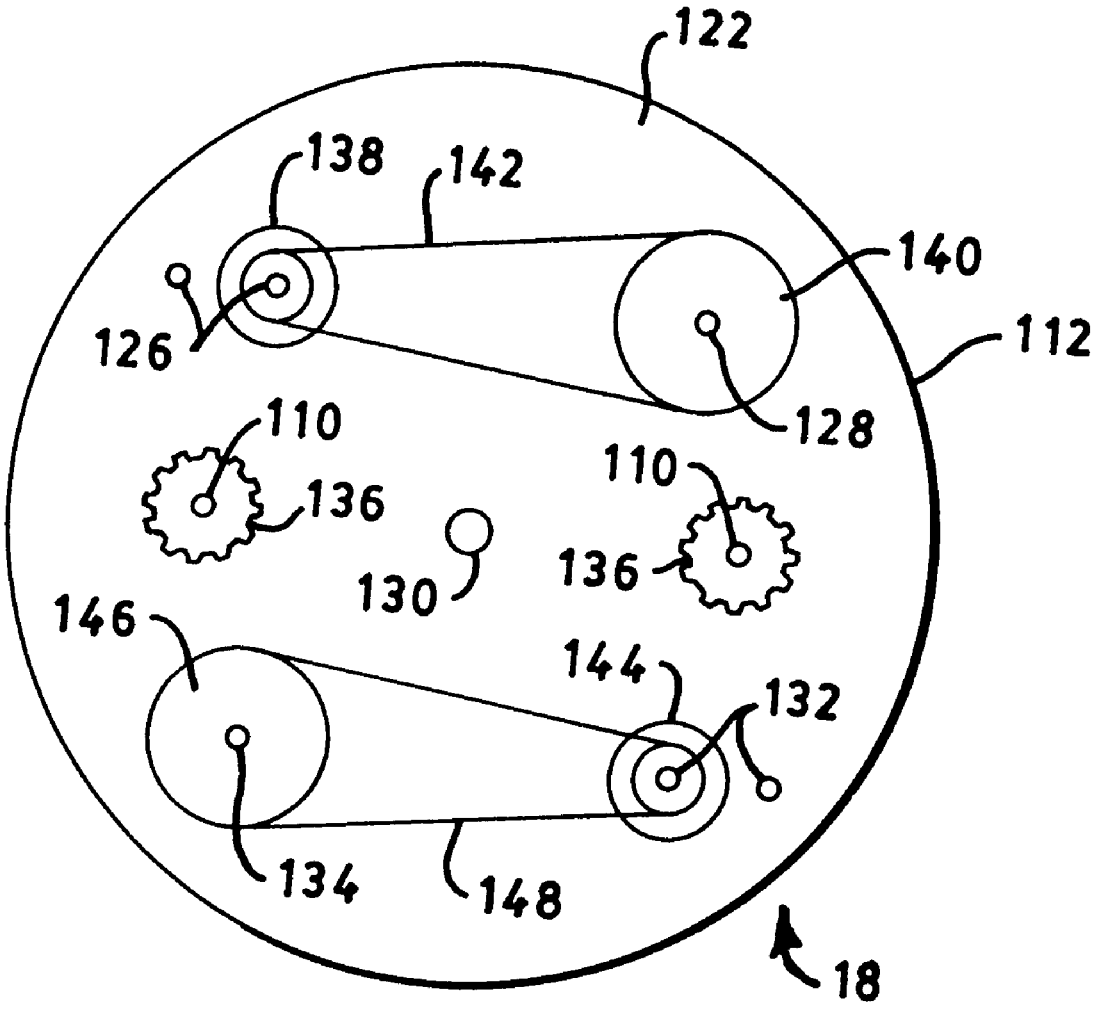
FIG. 7D illustrates the outside surface of the end plate as shown in FIG. 7B, including additional hardware for driving various system components.

The end plates 112 of the transfer buffer 18 are illustrated in FIGS. 7A–7D. FIG. 7A illustrates an inside surface 120 of an end plate 112; FIG. 7B illustrates an outside surface 122: FIG. 7C is a cross-sectional view along line A–A' with slots 124 drawn in shadow; and FIG. 7D is a view of the outside surface 122 of FIG. 7B, including additional hardware for driving various system components. The storage devices 28 and 30 are mounted onto the end plates 112, via axles 110 and with bearings 92 engaged into slots 124. Each slot 124 includes an indent 150 which accepts the bearings 92 when initializing the positions of the storage devices 28 and 30 prior to transferring media thereto.

FIG. 7A illustrates an inside surface 120 of an end plate 112 including: a rotating axle 130 around which the whole transfer buffer 18 rotates; axles 110 around which the storage devices 28 and 30 rotate; axles 126 of the drive rollers 34 of the storage device 28; axles 132 of the drive rollers 36 of the storage device 30; and slots 124 which engage the wheel bearings 92 of the storage devices 28 and 30. FIG. 7C clearly shows that the slots 124 are engageable with the bearings 92 from the inside surfaces 120 of the end plates 112.

In the preferred embodiments of the buffer 18 illustrated herein, the buffer is rotatable about an axis 130 as shown in FIG. 7A. However, the buffer 18 is not limited to being rotatable. For instance, the transfer of storage devices and the media stored within could occur by moving the storage devices within the buffer first along a linear path, and then turning the storage device 180 degrees to return along an adjacent linear path.

Figure 6:
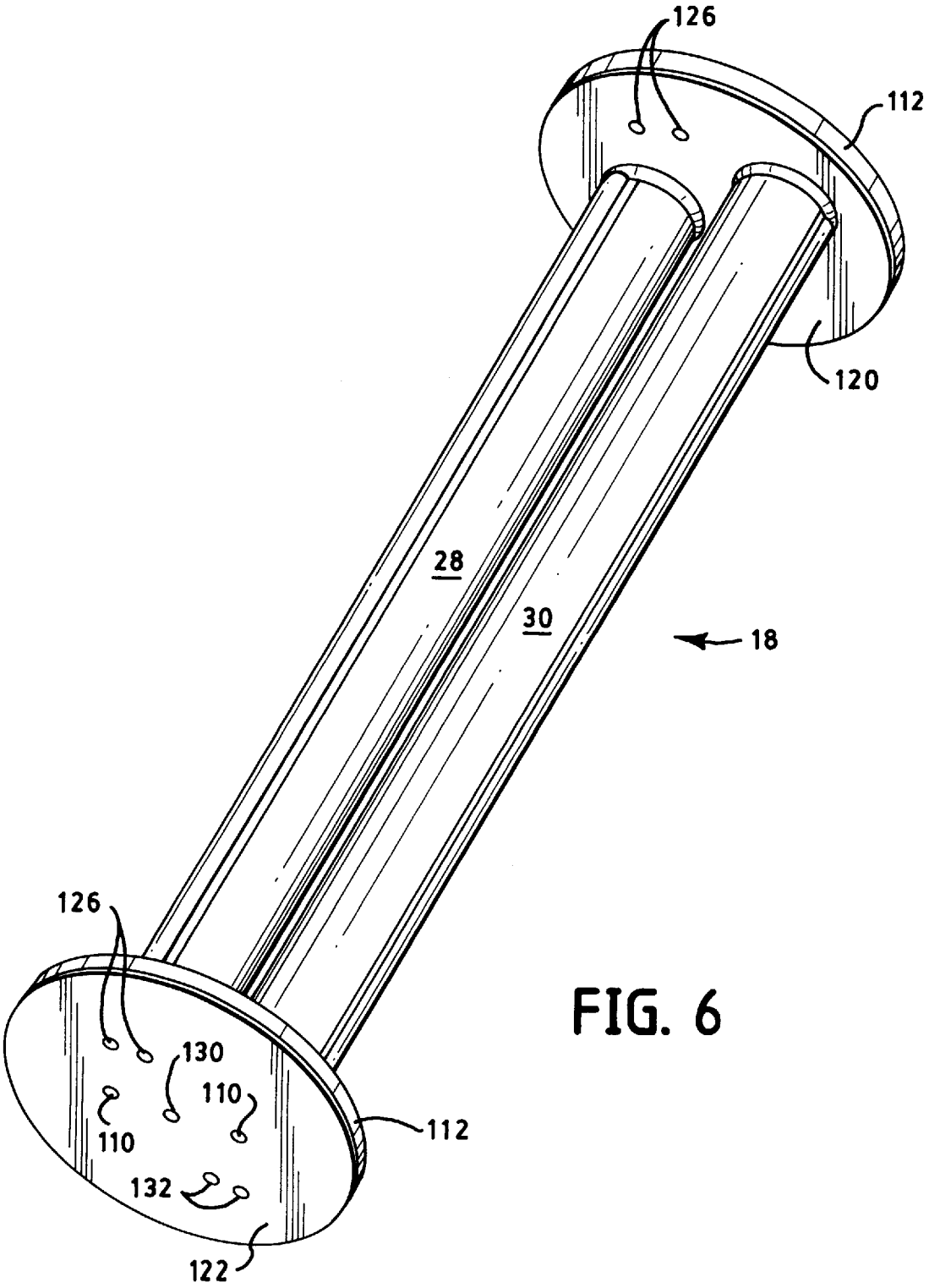
FIG. 6 is a perspective view of selected components of the transfer buffer of FIG. 1.

FIG. 6 is a perspective view of a partially constructed transfer buffer 18 which includes two storage devices 28 and 30. A motor (not shown) is connected, external to the transfer buffer 18, to a pulley 140 which rotates about an axis 128. A belt 142 connects pulley 140 to pulley 138 which, in turn, is connected to and drives one axle 126 of the rollers 34. The two rollers 34 form a tight nip therebetween so that when one roller 34 is driven, the other roller 34 follows. Similarly, rollers 36 are driven via a system containing a motor (not shown), a pulley 144 rotating about an axle 132 and a pulley rotating about an axis 146. The storage devices 28 and 30 are driven via an external motor (not shown) which engages the gears 136 to rotate the axles 110. The motors and associated hardware can be mounted external to, or within the transfer buffer 18, as desired. Moreover, the dimensions of the storage devices 28 and 30 are variable to accommodate different size media sheets.

Figure 8:
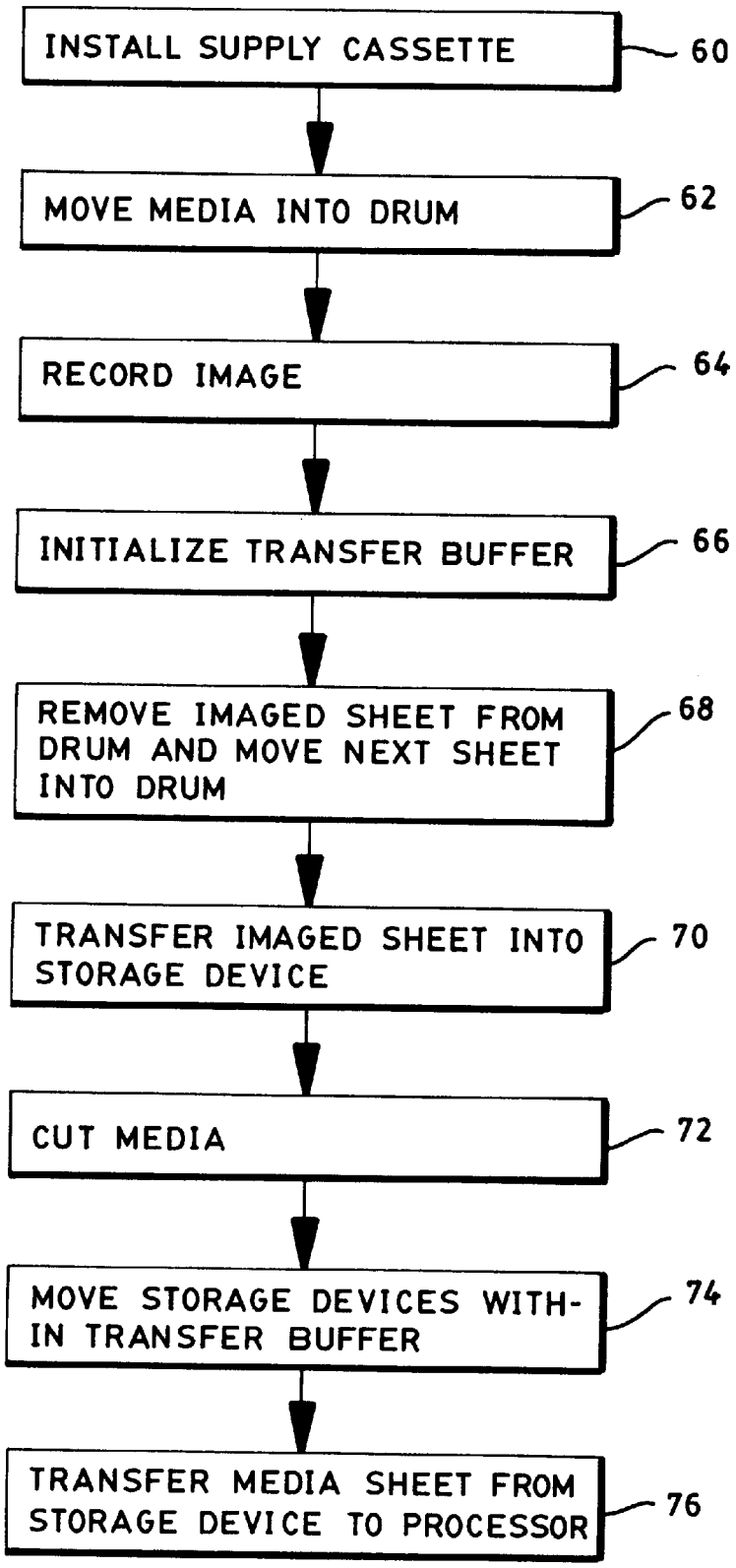
FIG. 8 is a flow chart outlining the operation of the imagesetting system of FIG. 1.

The operation of the imagesetting system 1 including the transfer buffer 18 is detailed by the flow chart of FIG. 8. The operating sequence is controlled by the controller 3 which, in turn is dependent upon software executed therein. At step 60, media 8 is provided to the imagesetter 10, for example by a supply cassette 11 also referred to as a web supply roll. Media may alternatively be supplied by a number of pre-cut sheets, for example stored in a stack. At step 62, the supply rollers 6 move the media 8 onto the recording support surface 9 of the drum 14. At step 64, the imagesetter 10 records a predetermined image onto the media 8 while it is located over the recording support surface 9. After or during the recording of the image onto the medium 8 and prior to removal of the medium 8 from the recording support surface 9, the transfer buffer 18 is initialized at step 66. The steps of initialization include (i) aligning the nip between the rollers 34 with the opening 23 of the platens 21, (ii) aligning the nip between the rollers 36 with the opening 37 of the platens 25, and (iii) indexing each of the bearings 92 into indents 150 of slots 124 of the end plates 112 (see FIGS. 5B and 7A). In the state of initialization, the leaf springs 90 are each in an open or extended position so that the retaining rod 102 is spaced apart from the body 100 of the storage device 28. Once the initialization is complete, the imaged medium 8 is removed from the drum via output rollers 15 and new media is brought into the drum from the supply cassette 11 via input rollers 6 at step 68. At step 70, the image sensor 17 detects the traversal of the leading edge of the media and initiates power to the drive rollers 34 at the same transfer speed as the rollers 6 and 15. The transfer speed of the various drive rollers indicates to the controller 3 the exact position of the leading edge of the imaged medium 8. Thus, the imaged medium 8 is driven through rollers 34 until it is positioned between the surface 104 and the bearing 92 as shown in FIG. 5B. At this point, the roller 100 of the storage device 28 is activated to rotate about its axis 110 at the same transfer speed as the other rollers, causing the rods 102 to move out of the indents 150 and to clamp down on the medium 8 as shown in FIG. 5C. The imaged medium 8 is thereafter wrapped onto the external surface of the roller 100 as shown in FIG. 5C. Note that once the roller 100 begins to turn, the spring 90 is contracted so that the bearing 92 is removed from its initial position in the indent 150 (FIG. 7A). The bearing 92 thus pinches the medium 8 onto the surface 104, holding the medium 8 in place as it wraps around the roller 100 as illustrated in FIG. 7C.

When the appropriate length of media 8 has passed by the sensor 17, the cutters 16 cut the medium sheet and the rollers 6 and 15 stop (step 72). The drive rollers 34 and the roller 100 in the storage device 28 continue to operate until the trailing edge of the cut medium is in the vicinity of the opening 23. At this point, the drive rollers 34 and 100 stop and the first cut sheet of media is fully stored in the storage device 28. A next image is transferred onto the media in the drum as previously described. Meanwhile, at step 74 the transfer buffer 18 moves the storage devices therein. For instance, for the cylindrically shaped transfer buffer 18 shown in FIGS. 2–4, the buffer is moved so that the nip between the rollers 34 is now aligned with the opening 37 of the platens 25 and the nip between the rollers 36 is aligned with the opening 23 of the platens 21. In this way, the cut medium 8 which is stored on the storage device 28 is ready for transfer into the processor 12, while an empty storage device 30 is available to receive the next sheet of imaged medium 8 from the drum 14. At step 76, the drive rollers 34 and 100 are activated and the medium 8 stored in the storage device 28 is transferred through the platen 25 into the processor 12. When the sensor 22 detects the leading edge of the medium 8, it transmits an electronic signal to the controller 3 which, in turn, activates the processor input rollers 20 at the same transfer rate as the rollers 34 and 100. When the trailing edge of the medium 8 being transferred into the processor 12 is detected by the sensor 22, the rollers 34 and 100 are deactivated.

The above described process repeats itself for each imaged sheet of media 8. Thus, media sheets are either being input into the drum or imaged, while simultaneously being transferred from the drum into the transfer buffer 18, and transferred from the transfer buffer 18 to the processor 12. In this manner, the imagesetting system 1 operates at a high level of efficiency.

Although the first and second preferred embodiments of the present invention, as described herebefore with reference to the drawings, include a generally cylindrically shaped transfer buffer 18, the particular shape of the buffer 18 is not critical to the principles of the invention. Hence, the transfer buffer 18 is not limited to a cylindrical shape. In fact, the movement of the storage devices 28 and 30 from one point to another within the buffer 18 can be implemented by any known transfer means, such as via a belt driven or chain driven transfer system. The particular cylindrical shape of the embodiments of the transfer buffer 18 illustrated in the drawings allows an easy manner to transfer the storage devices from one point to another within the buffer 18. In fact rather than rotating, the buffer 18 could cause the devices to move in a linear path or along a combination of linear and angular paths. Any path for transferring the media (via multiple storage devices) from one component to another within the imagesetting system 1 is a viable alternative for implementing the inventive concepts.

The general principles of the invention are presented in view of the previously described preferred embodiments. However, those principles are applicable in many variants of an imagesetting system. For instance, the transfer buffer could be used with any internal or external drum imagesetting system. In fact the transfer buffer could be more broadly used to transfer and buffer any imaged media between any two stages or components within a system. For instance in a system which digitally images media, the transfer buffer could be used to transfer media between the drum and the mechanical finishing unit (which would be necessary in place of the chemical processor described herebefore).

Having described the preferred embodiments of the invention other embodiments which incorporate the concepts of the invention will now become apparent to one skilled in the art. Therefore, the invention should not be viewed as limited to the disclosed embodiments but rather should be viewed as limited only by the scope of the appended claims.

What is claimed is:

1. A method for transferring sheets of media between first and second components of an imagesetting system, the method comprising the steps of:

rotating a transfer buffer comprising at least two assemblies about a transfer buffer axis, to align a first assembly with the first component while concurrently aligning a second assembly with the second component, each of said assemblies comprising a storage device, having an axis, for storing one of the sheets of media, and a pair of drive rollers having drive roller axes, said transfer buffer axis being parallel to said storage device axes and said drive roller axes;

transferring a first sheet of said media from the first component to the first assembly;

moving the transfer buffer to align the first assembly with the second component while concurrently aligning the second assembly with the first component; and transferring the first sheet of said media from the first assembly to the second component while simultaneously transferring a second sheet of said media from the first component to the second assembly.

2. The method of claim 1 wherein the first component is an internal or external drum for imaging.

3. The method of claim 1 wherein the second component is a chemical processor or mechanical finisher.

4. The method of claim 1, wherein the storage devices are removable.

5. The method of claim 1 wherein the transfer buffer is removable.

6. A method for transferring imaged sheets of media between a drum of an imagesetter and a media processor, the method comprising the steps of:

rotating a transfer buffer having at least two assemblies about a transfer buffer axis, to align a first assembly with a media path from the drum, said assemblies each comprising a storage device with a storage device axis and a pair of drive rollers with drive roller axes, said transfer buffer axis, said storage device axes and said drive roller axes being parallel to one another;

transferring a first sheet of said media from the drum through the media path to the first assembly;

rotating the transfer buffer along the transfer buffer axis to align the first assembly with an input to the media processor and to concurrently align a second assembly with the media path from the drum; and transferring the first sheet of said media to the input of the media processor while simultaneously transferring a second sheet of said media from the drum through the media path to the second assembly.

7. The method of claim 6 wherein the media processor is a chemical media processor or a mechanical finishing processor.

8. The method of claim 6 wherein the drum is an external imaging drum or an internal imaging drum.

9. The method of claim 6 wherein the first and second assemblies are removable.

10. The method of claim 6 wherein the transfer buffer is removable.

11. A system for transferring imaged sheets of media between a drum of an imagesetter and a media processor, the system comprising:

means for rotating a transfer buffer having at least two assemblies about a transfer buffer axis, each of said assemblies comprising a storage device, having an axis, for storing one of the sheets of media, and a pair of drive rollers having drive roller axes, to align a first assembly with a media path from the drum while concurrently aligning a second assembly with an input to the media processor, said transfer buffer axis being parallel to said storage device axes and said drive roller axes;

means for transferring a first sheet of said media from the drum through the media path to the first storage device in the first assembly;

means for rotating the transfer buffer to align the first with the input to the media processor while concurrently aligning the second assembly with the media path from the drum; and means for transferring the first sheet of said media to the input of the media processor while simultaneously transferring a second sheet of said media from the drum through the media path to the second assembly.

* * * * *